United States Patent [19]

Gagnon

[11] Patent Number: 4,740,111

[45] Date of Patent: Apr. 26, 1988

[54] FRICTION WASHER FOR SECURING A WIRE MESH SCREENING ONTO THE PROTRUDING END OF ROCK BOLTS

[75] Inventor: Donald Gagnon, Bathurst, Canada

[73] Assignee: Brunswick Mining and Smelting Corporation Limited, Bathurst, Canada

[21] Appl. No.: 889,618

[22] Filed: Jul. 28, 1986

[30] Foreign Application Priority Data

Aug. 1, 1985 [CA] Canada ..... 487993

[51] Int. Cl.[4] ..... E21D 11/00; E21D 21/00

[52] U.S. Cl. ..... 405/259; 405/288; 411/533

[58] Field of Search ..... 405/150, 132, 259, 288; 411/531, 533

[56] References Cited

U.S. PATENT DOCUMENTS

| | | | |
|---|---|---|---|
| 3,181,584 | 5/1965 | Borowsky | 411/533 X |
| 3,362,737 | 1/1968 | Cobb | 411/533 X |
| 3,504,498 | 4/1970 | Triplett | 405/259 X |
| 4,293,243 | 10/1981 | Graybeal et al. | 405/259 |
| 4,325,657 | 4/1982 | Elders | 405/259 |
| 4,371,288 | 2/1983 | Borca | 405/150 X |

*Primary Examiner*—David H. Corbin

*Attorney, Agent, or Firm*—Fleit, Jacobson, Cohn & Price

[57] ABSTRACT

A friction washer for securing a wire mesh screening on the protruding end of rock bolts inserted into the wall of a mine is disclosed. The friction washer has a central opening with teeth set into the inside diameter thereof and adapted to engage the end of the bolts. A plurality of upstanding tabs are located on one face of the friction washer and radially spaced from the center of the central opening at a distance substantially equal to half the outside diameter of a hollow tube so as to allow the tabs to fit over the end of the hollow tube for holding the washer during installation on the protruding end of the rock bolt.

5 Claims, 2 Drawing Sheets

FRICTION WASHER FOR SECURING A WIRE MESH SCREENING ONTO THE PROTRUDING END OF ROCK BOLTS

This invention relates to friction washers, and more particularly to a friction washer for securing a wire mesh screening onto the protruding end of rock bolts used for mine wall and roof stabilization.

Since the introduction of double threaded bolts, applicant has been searching for a mechanical device to secure wire mesh screening onto the ends of the rock bolts which protrude from the wall of the mine so as to eliminate the need for drilling additional holes for anchoring the wire mesh screening. One obvious method was to secure the wire mesh screening using a second nut on the rock bolts. However this operation was found to be labor extensive. Two other types of fasteners were considered, the first one being a sectional cone type, tapered to lock onto the exposed threads of the rock bolts, which would have secured the screening using a standard rock bolt plate, the second one being a friction washer having a central opening with teeth set into the inside diameter which would allow the washer to be pushed onto the threads but would resist sliding in the opposite direction. Initial investigation of the cone type showed that cost would be prohibitive and installation would be a problem. On the other hand, standard friction washers obtained from Atlas Copco could only sustain a maximum pressure of 600 pounds before starting to slip on the rock bolts. In addition, some type of a tool was required to hold the washers during installation onto the rock bolts. Furthermore, as the screening normally used in the mines have a wire mesh size larger than the diameter of the conventional friction washers, installation of a plate larger than the wire mesh size was required to secure the screening to the rock bolts.

Applicant has overcome the above problems by providing a special type of friction washer which is strong enough to resist a pulling force of about 1,800 pounds and may be easily installed by hand using a simple hollow tube.

The friction washer, in accordance with the present invention, comprises a central opening having teeth set into the inside diameter thereof and adapted to engage the protruding end of the rock bolt, and a plurality of upstanding tabs located on one face of the washer and radially spaced from the center of such central opening a a distance subtantially equal to half the outside diameter of a hollow tube so as to allow the tab to fit over the end of the hollow tube for holding the washer during installation on the protruding end of the rock bolt.

In accordance with a second feature of the present invention, the friction washer may be provided with two upstanding bent edges on the face of the washer opposite from the upstanding tabs so as to allow mounting of a plate on the washer prior to installation of the washer on the protruding end of the rock bolt in order to allow securing of a screening having a wire mesh size larger than the diameter of the friction washer.

The protruding end of the rock bolt is normally threaded although the friction washer could possibly be installed on the end of a rock bolt having a smooth protruding end of a length sufficient to allow the teeth of the friction washer to grip into the end of the rock bolt.

The hollow tube used for holding the friction washers during installation is conveniently a conventional socket wrench which is normally used on a pneumatic drill for threading the rock bolts into the ground.

The invention will now be disclosed, by way of example, with reference to a preferred embodiment illustrated in the accompanying drawings in which.

Figure 1:
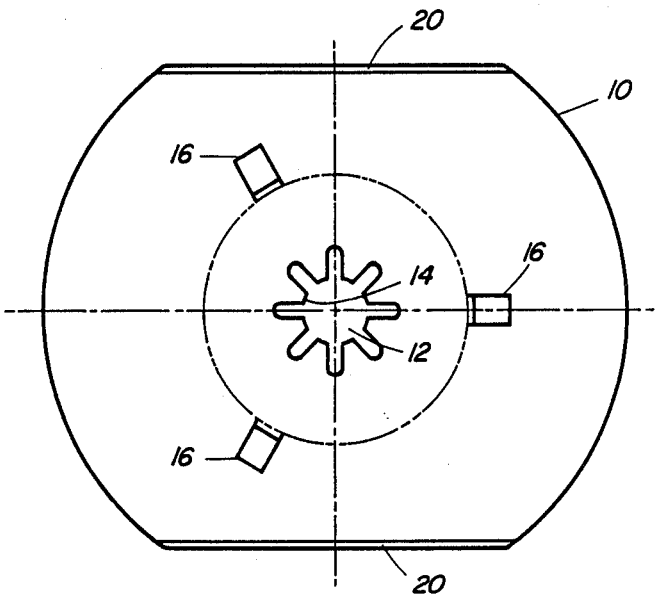
FIG. 1 is a top view of a friction washer in accordance with the present invention.
Figure 2:
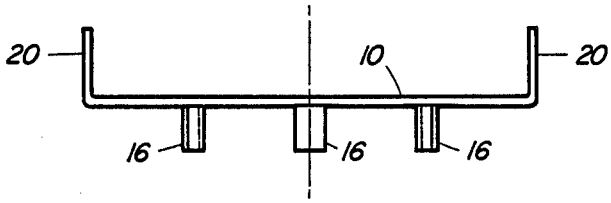
FIG. 2 is a side view of the friction washer shown in FIG. 1.
Figure 3:
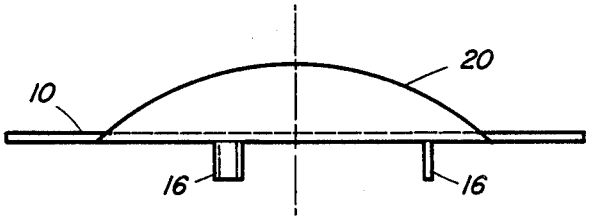
FIG. 3 is an end view of the friction washer shown in FIG. 1.

Referring to the drawings, there is shown a friction washer 10 made of tempered mild steel and having a central opening 12 with teeth 14 set into the inside diameter thereof and adapted to engage the end of a rock bolt . The washer has a plurality of upstanding tabs 16 located on one face thereof and radially spaced from the center of the central opening 12 at a distance equal to half the outside diameter of a hollow tube such as a socket wrench 18 so as to allow the tabs to fit over the end of the socket wrench for holding the washer during installation.

The friction washer has two upstanding bent edges 20 on the face of the washer opposite to the upstanding tabs so as to allow mounting of a plate 22 on the washer prior to installation of the washer on the protruding end of the rock bolt. The plate 22 is longer than the wire mesh size of the screening in order to allow securing of a screening having a wire mesh size larger than the friction washer. The plate 22 is preferably made of wood to avoid corrosion of dissimilar metals.

Figure 4:
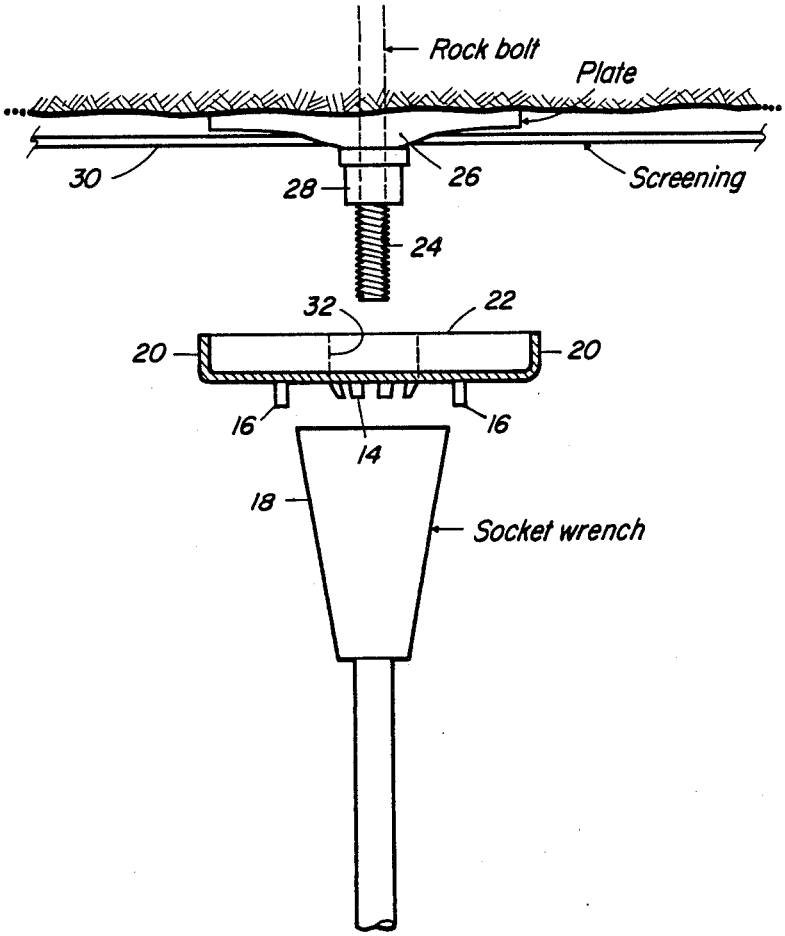
FIG. 4 is a schematic view illustrating installation of the wire mesh screening onto the end of a rock bolt.

Referring to FIG. 4, there is shown a double threaded rock bolt 24 which is anchored into the rock. A standard rock bolt plate 26 is tightened against the rock by a nut 28. A wire mesh screening 30 is installed on the protruding end of the rock bolt using the above disclosed friction washer 10. During installation, wooden plate 22 having a central opening 32 is first placed between the bent edges of the friction washer and the assembly is then fixed to the end of the socket wrench 18 by fitting the tabs 16 of the friction washer over the end of the socket wrench. The friction washer is then pushed onto the end of the rock bolt to secure the screening beween the standard rock bolt plate 26 and the wooden plate 22. The operation is simple and may be done by hand in a minimum period of time.

Preliminary pull tests were done on a tempered mild steel friction washer having a diameter of 5 inches and a thickness of 0.06 inch using a stud tensioner. The threaded section of the rock bolt was inserted into the tensioner and the friction washer was forced onto the rock bolt. The force required to back the washer off the rock bolt was approximately 1,800 pounds. The results of these tests demonstrated that the washers could support the screen adequately.

Screen pull tests were also done using a tension gauge, a two ton chain fall and a one foot square, $\frac{3}{8}$ inch steel plate with an eye bolt in the center. A section of a standard mine screening was secured to a wall using tempered mild steel friction washers having a diameter of 5 inches and a thickness of 0.06 inch. The friction washers were pushed on rock bolts spaced 5 feet apart around a square with the steel plate positioned at the center of the square. Readings were taken from the gauge as well as deformation as measured from the wall to the steel plate. On the average, the friction washers started to slip on the rock bolts when about 3,800 pounds were applied to the plate. The deformation from the wall to the steel plate was about 30 inches.

The results of the above screen pulling tests show that at least 1.5 ton of loose material could be retained on the screening. Assuming that a piece of loose material 3'×3'×1' weighs approximately 2,400 pounds (267 lbs./ cu. ft. unbroken ore) there is a reasonable margin of safety.

Although this invention has been disclosed with reference to a preferred embodiment, it is to be understood that it is not to be limited to such embodiment and that other alternatives are envisaged within the scope of the following claims.

I claim:

1. A friction washer used for securing a wire mesh screening on the protruding end of rock bolts inserted into the wall of a mine by using a single hollow tubular tool, said friction washer comprising:

a central opening with teeth set into the inside diameter thereof and adapted to be pushed onto the end of the bolts, said teeth being located on the face of the washer opposite the wire mesh; and at least three downwardly projecting tab means for enabling the installation of the washer by using the single hollow tubular tool, said tab means being located on the same face of the washer as said teeth and being radially and circumferentially spaced from the center of said central opening at a distance substantially equal to half the outside diameter of the hollow tubular tool so as to cause said tab means to circumferentially surround said teeth and to fit over the end of the hollow tubular tool for holding the washer during installation on the protruding end of the rock bolt.

2. A friction washer as defined in claim 1, further comprising two upstanding bent edges on the face of the washer opposite to the downwardly projecting tab means for holding a plate on the washer which is longer than the diameter of the washer, said plate allowing securing of a screening having a wire mesh size larger than the diameter of the friction washer.

3. A friction washer as defined in claim 1 wherein the protruding end of the rock bolts is threaded.

4. A friction washer as defined in claim 1, wherein the hollow tube is a socket wrench normally used on a pneumatic drill.

5. A friction washer as defined in claim 1, wherein the washer is made of tempered mild steel.

* * * * *